US005836536A

United States Patent [19]

Bodden

[11] Patent Number: 5,836,536

[45] Date of Patent: Nov. 17, 1998

[54] CABLE STORAGE ASSEMBLY

[76] Inventor: Roland L. Bodden, 3324 Cavendish Pl., Harvey, La. 70058

[21] Appl. No.: 887,058

[22] Filed: Jul. 2, 1997

[51] Int. Cl.[6] ..... B65H 75/34; B65H 75/30

[52] U.S. Cl. ..... 242/390.5; 242/390.8; 242/394; 242/404; 242/406

[58] Field of Search ..... 242/389, 390, 242/390.2, 390.5, 390.6, 390.8, 390.9, 394, 396.6, 399, 399.1, 403, 404, 404.2, 404.3, 406, 470, 533, 539, 559, 559.4; 254/345, 358, 380

[56] References Cited

U.S. PATENT DOCUMENTS

| | | | |
|---|---|---|---|
| 1,806,549 | 5/1931 | Wallace | 242/389 |
| 2,126,172 | 8/1938 | Cartlidge | 242/390.8 |
| 2,223,110 | 11/1940 | Kempe | 242/390.2 |
| 2,290,037 | 7/1942 | Dennison | 242/389 |
| 2,326,556 | 8/1943 | Opsal | 242/390 |
| 2,412,508 | 12/1946 | Jensen | 242/390.2 |
| 2,954,190 | 9/1960 | Le Clair | 242/390.8 |
| 3,000,587 | 9/1961 | Goode | 242/390 |
| 4,260,287 | 4/1981 | Uyeda et al. | 242/390.6 |
| 4,664,331 | 5/1987 | Halbrook | 242/390.5 |

*Primary Examiner*—John M. Jillions
*Attorney, Agent, or Firm*—Keaty & Keaty

[57] ABSTRACT

The invention relates to an assembly for storing lengths of cables, chains, or conduits wound on a spool. The assembly has a stationary portion that supports a motor and a removable portion that supports a spool for receiving a length of a cable, chain or conduit. The motor is operationally connected to a sprocket wheel, which forms a part of the stationary portion, and when the sprocket wheel is moved into engagement with the chain fitted on the spool, the rotating force is transmitted to the spool, allowing winding of the cable, chain or conduit thereon. Any number of removable portions can be used for winding of a predetermined length of cables, chains, or conduits using the same stationary portion.

19 Claims, 7 Drawing Sheets

CABLE STORAGE ASSEMBLY

BACKGROUND OF THE INVENTION

The present invention relates to a cable storage equipment, and in particular to an assembly for storing a length of cable typically found on offshore platforms.

Offshore oil and gas exploration and production is conventionally conducted from floating platforms that are positioned at a desired location some distance from the shoreline and are equipped with the necessary facilities for conducting well operations. The floating offshore platforms serve not only as a base for well equipment but often times provide living quarters for the personnel working on the platform for weeks, even months, at a time. Therefore, the platforms are designed to accommodate the living facilities, as well as equipment that is necessary for conducting the desired type of operation. The space on such platforms is of a premium value, since any additional platform size translates into a considerable increase in the cost of manufacturing and operating the offshore platform.

In order to maximize the available space for conducting of the necessary operations, a service barge or vessel often accompanies an offshore platform. The service vessels store spare equipment, replacement parts, buoys and other similar items which are not of immediate need on the decks of an offshore platform. The cost of oil production and operation, therefore, takes into account the expense of operating the service barges or boats assigned to work alongside the offshore platform.

During an offshore operation, it often becomes necessary to store considerable lengths of cable, anchor chains for securing buoys used to mark the position of a pipeline in the open seas. Oftentimes, the cable is stored in a heap somewhere on a deck of a platform, or on a service vessel, requiring untangling and organizing when the cable needs to be re-used. The present invention contemplates provision of an assembly for storing lengths of cables, chains or conduits in an organized manner, making it ready for use in a matter of minutes.

SUMMARY OF THE INVENTION

It is, therefore, an object of the present invention to provide an assembly for storing lengths of cable, an anchor chain or conduits.

It is another object of the present invention to provide an assembly for storing cable and similar items in a relatively small amount of space, ready to be used upon demand.

It is a further object of the present invention to provide a cable storage assembly which is particularly suitable for use in situations where storage space is at a premium.

These and other objects of the present invention are achieved through a provision of a cable storage assembly that comprises a stationary portion and a removable portion detachably engageable with the stationary portion. The stationary portion carries an operational part of the assembly, comprised of a motor supported by an upright frame, a driving shaft, and a second elongated shaft connected to the drive shaft by an endless chain. When the drive shaft is rotated by the motor, rotation is transmitted through the endless chain to the elongated shaft.

One end of the elongated shaft is provided with a sprocket wheel, the second end of the wheel being telescopically engaged in a sleeve. The second end of the elongated shaft carries a rotating handle that allows the elongated shaft to move in and out of engagement with the removable portion.

The removable portion comprises a base and an upright support which carries a spool adapted for receiving a length of cable, chain, or a similar item wound thereon. One end of the spool carries a chain fitted on the interior wall of the spool. The links of the chain correspond to the size and shape of the sprocket wheel of the stationary portion. When the removable portion is moved to rest on the base of the stationary portion, the sprocket wheel is advanced by rotation of the handle toward the spool. The teeth of the sprocket engage the chain mounted in the spool and transmit torque from the motor to the spool, allowing winding of the chain on the spool.

After a predetermined length of the chain, or cable is wound on the spool, the sprocket wheel is moved out of engagement with the chain of the spool, thereby disengaging the removable portion from the driving shaft of the motor. The removable portion can then be lifted by a crane or other suitable means and moved to a location convenient for storage of the cable wound on the removable portion.

Another removable portion with an empty spool is then moved into engagement with the stationary portion, and another length of chain, or cable is wound on the second spool in a manner similar to that described above. As a result, any desired lengths of cables, chains, or conduits can be conveniently stored on a plurality of removable portions, away from the main operation areas of a platform.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 1:
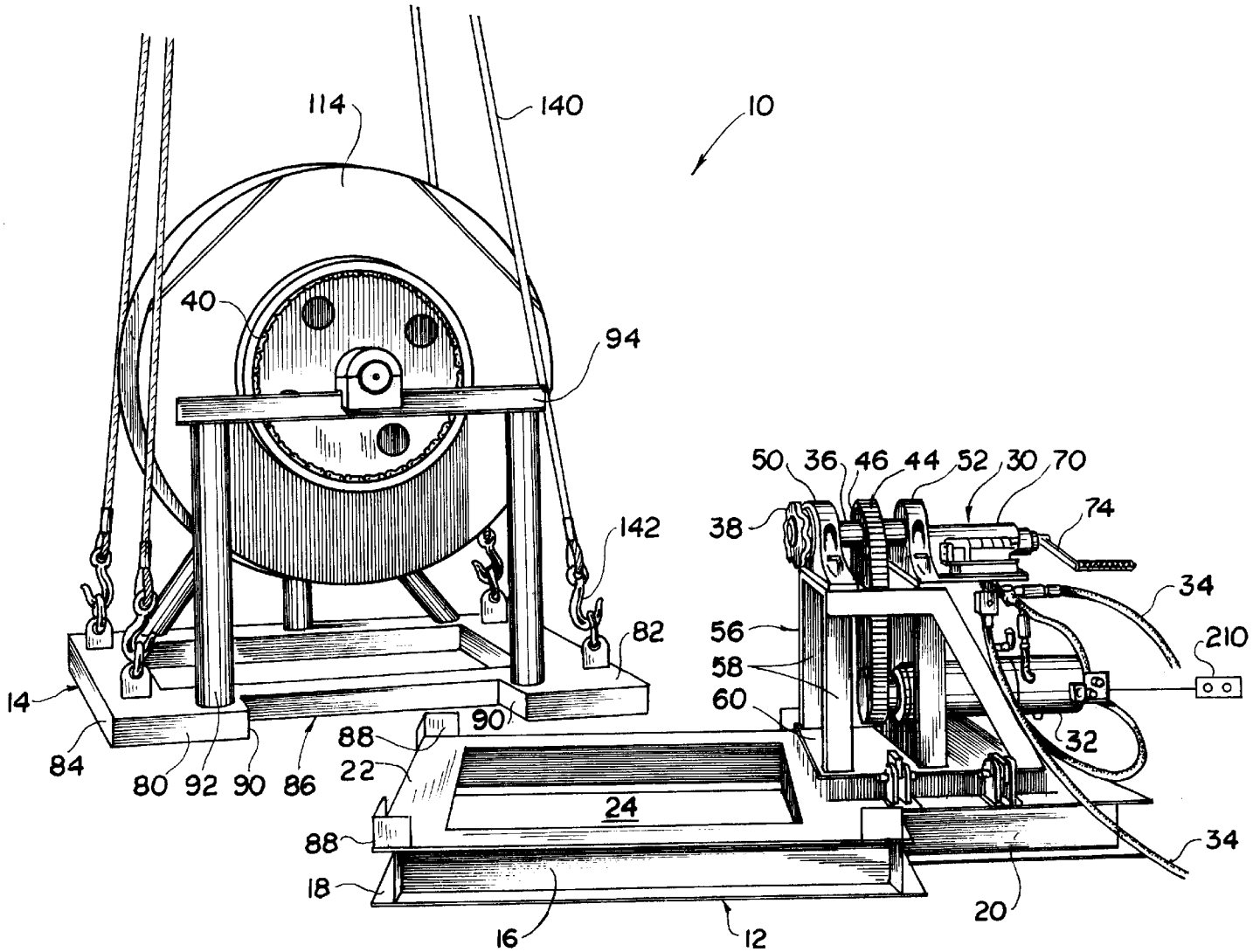
FIG. 1 is a perspective view of the storage assembly in accordance with the present invention.

Turning now to the drawings in more detail, numeral 10 designates an assembly for storing lengths of cable in accordance with the present invention. The assembly 10 comprises a stationary portion 12 and a detachably removable portion 14. The stationary portion 12 comprises a support base 16 adapted to rest on a horizontal surface, for example a deck of an offshore platform. The base 16 has a bottom plate 18, a vertically extending wall 20 and an upper plate 22. The base 16 has an opening 24 formed in the top plate 22 and the bottom plate 18. The perimeter of the opening 24 is defined by the vertical wall 20.

Figure 5:
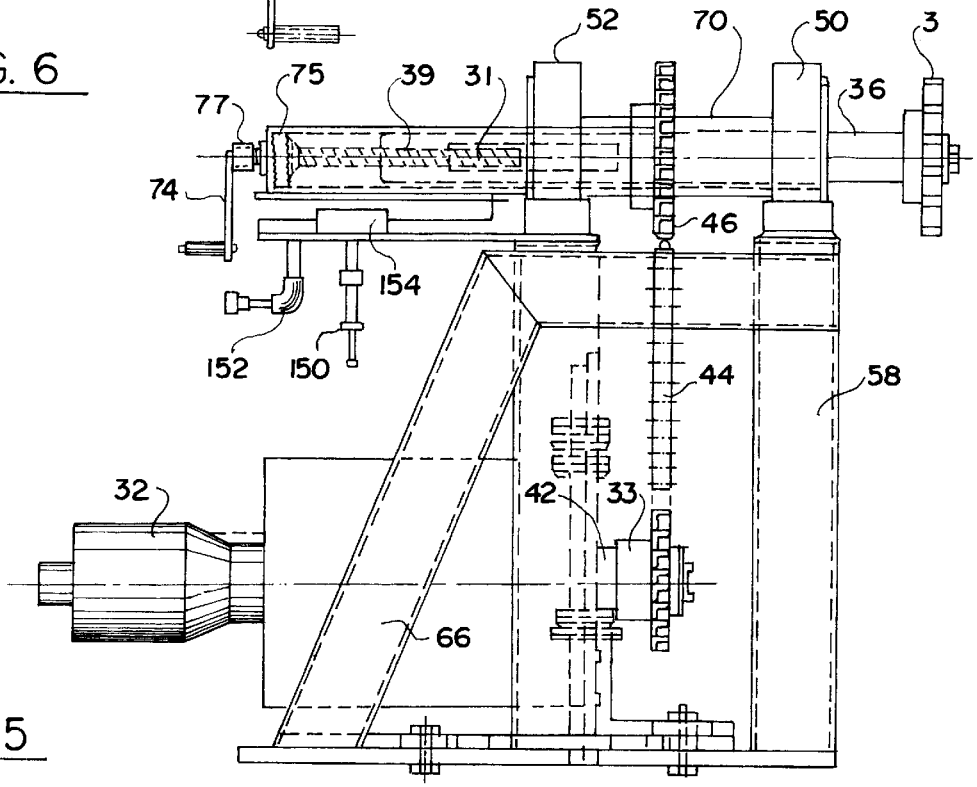
FIG. 5 is a detail elevation view of the drive assembly.

Mounted on the top plate 22, adjacent to opening 24, is an operational portion 30, or drive mechanism of the assembly 10, as can be better seen in FIG. 5. The operational portion 30 comprises a motor 32 which can be a pneumatic, hydraulic or an electric motor, as selected, connected to a source of power by a plurality of cables or hoses 34. The motor 32 has a driving shaft 42 which rotates in response to a force generated by the motor 32, moving a sprocket 33 and transmitting torque to a driver sprocket 46 via endless chain 44.

A second rotating shaft or sleeve 70 is adapted for rotation about its axis in response to the rotational force transmitted by the endless chain 44 to the sprocket 46, which is rigidly engaged with the shaft 70, thus, allowing rotation of the shaft 70 in unison with the shaft 42.

Figure 2:
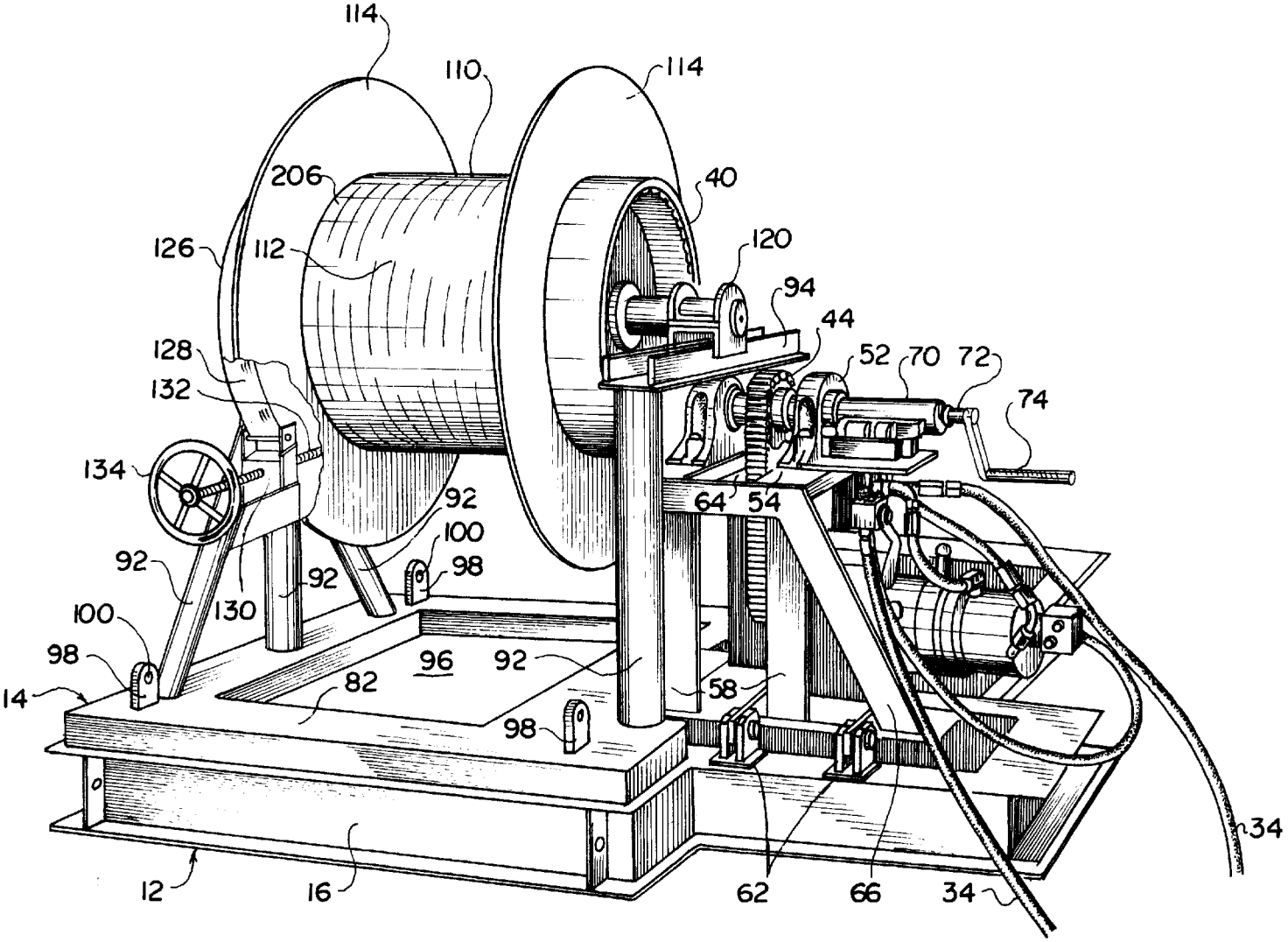
FIG. 2 is a perspective, partially cutaway, view of the assembly ready to receive a length of cable, or a similar item.

The sprocket 46 is mounted midway on the shaft 70, and a pair of bearings 50, 52 receive opposite ends of the shaft 70. The bearings 50, 52 are fixedly secured, such as by bolts, or the like, to a top plate 54 of a motor support frame 56. The support frame 56 has a plurality of vertical legs, or support members 58 that rest on a platform 60, as shown in FIGS. 1 and 2. The platform 60 is engaged, by suitable engaging brackets 62, to the top plate 22 of the base 16.

An opening 64 is formed in the plate 54 to accommodate an upper portion of the chain 44 extending therein. If desired, the support frame 56 can be further reenforced by one or more angular beams 66 secured to the plate 54 and the vertical frame legs 58. The lower end of the angular support members 66 rests on the plate 60 and is engaged thereto by welding or other suitable means.

Figure 6:
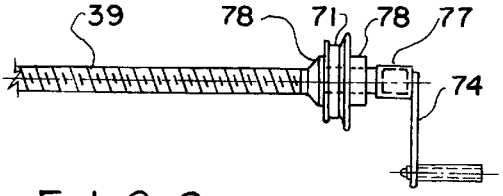
FIG. 6 is a detail view showing the adjusting screw and handle.
Figure 10:
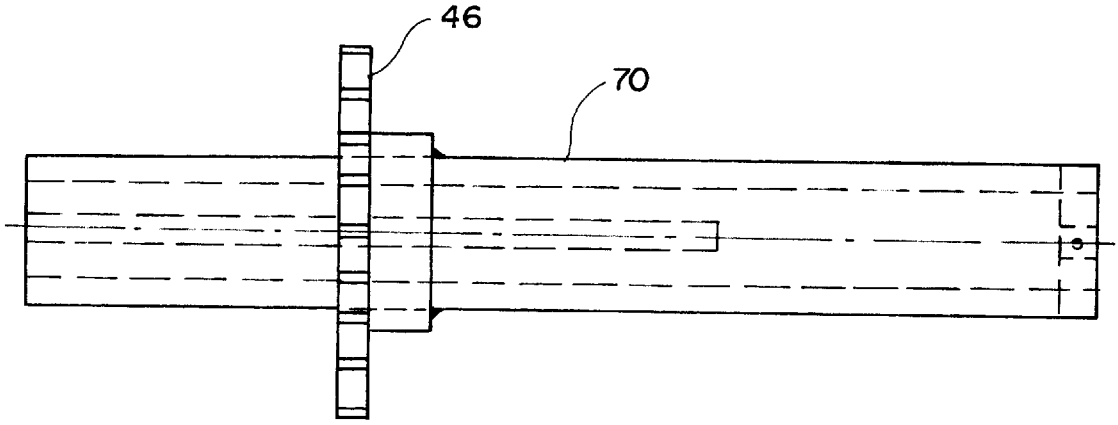
FIG. 10 is a side elevational view of a second rotating shaft, or a sleeve showing a driver sprocket.
Figure 11:
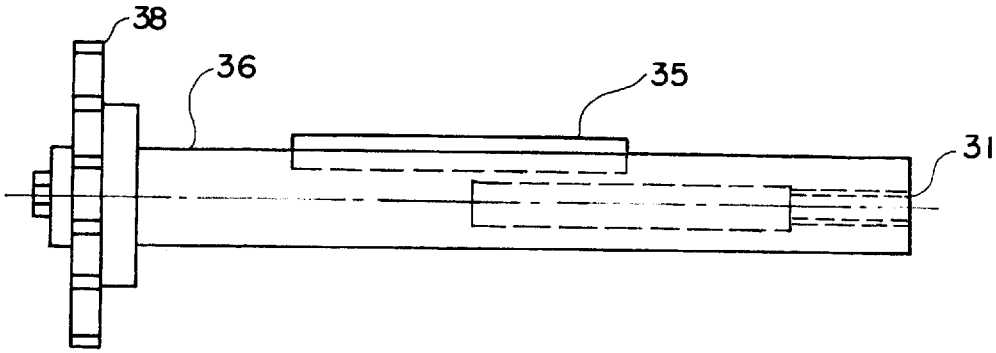
FIG. 11 is a side elevational view an inner elongated shaft showing a key.
Figure 12:
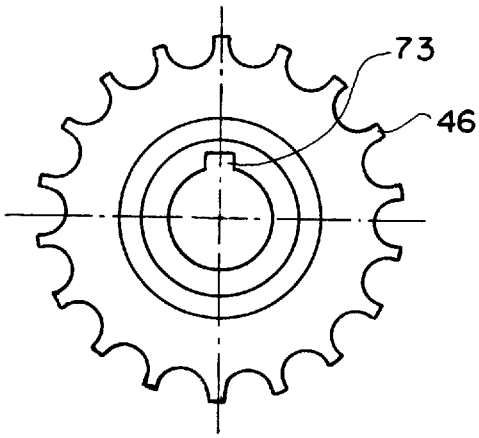
FIG. 12 is an end view of a second rotating sleeve showing the driver sprocket and a keyway.

With reference to FIG. 5, the rotating cylindrical shaft, or sleeve 70 (shown in greater detail in FIG. 10) is seen supported by bearings 50 and 52. Within the sleeve 70 is seen an inner elongated shaft 36 (shown in greater detail in FIG. 11) with adjusting screw 39 (shown in greater detail in FIG. 6). The rotating cylindrical shaft, or sleeve 70 is bored and keywayed (shown in greater detail in FIG. 12) to the size sufficient to accommodate the elongated shaft 36 and to allow for a longitudinal movement of the elongated shaft therein.

The elongated shaft 36 is fitted with a key 35 (see FIG. 11) that engages with keyway 73 (see FIG. 12) in the sleeve 70. This allows the elongated shaft 36 to be telescopically extended or retracted in relation to the sleeve 70. It also allows the two shafts to rotate together when torque is applied via motor 32. The elongated shaft 36 is fitted with a female threaded opening 31 for receiving the adjusting screw 39. The adjusting screw 39 is fitted with a bearing 71 that is kept in place by stops 78. Handle 74 is a removable part of the screw 39. A pin 77 allows the handle 74 to be attached or readily disengaged from the screw 39. When the pin 77 is removed, the handle 74 can be disengaged which leaves the screw 39 free floating.

Referring again to FIGS. 5 and 6, the elongated shaft 36 and adjusting screw 39 are seen in place with sleeve 70. The adjusting screw bearing 71 is fixedly secured to the sleeve 70 by a plurality of set screws 75. The inside end of the adjusting screw 39 is seen threaded into the female threaded opening 31 (see FIG. 11) on the end of the elongated shaft 36. With longitudinal movement of adjusting screw 39 prevented by the stops 78 and the set screws 75, clockwise rotation of the handle 74 causes the adjusting screw 39 to move into the female threaded opening 31 on the end of the elongated shaft 36, thus retracting the shaft backward into the sleeve 70. Likewise, the opposite occurs when the handle 74 is rotated counter-clockwise thus extending the elongated shaft outward toward the front of the sleeve 70.

Figure 4:
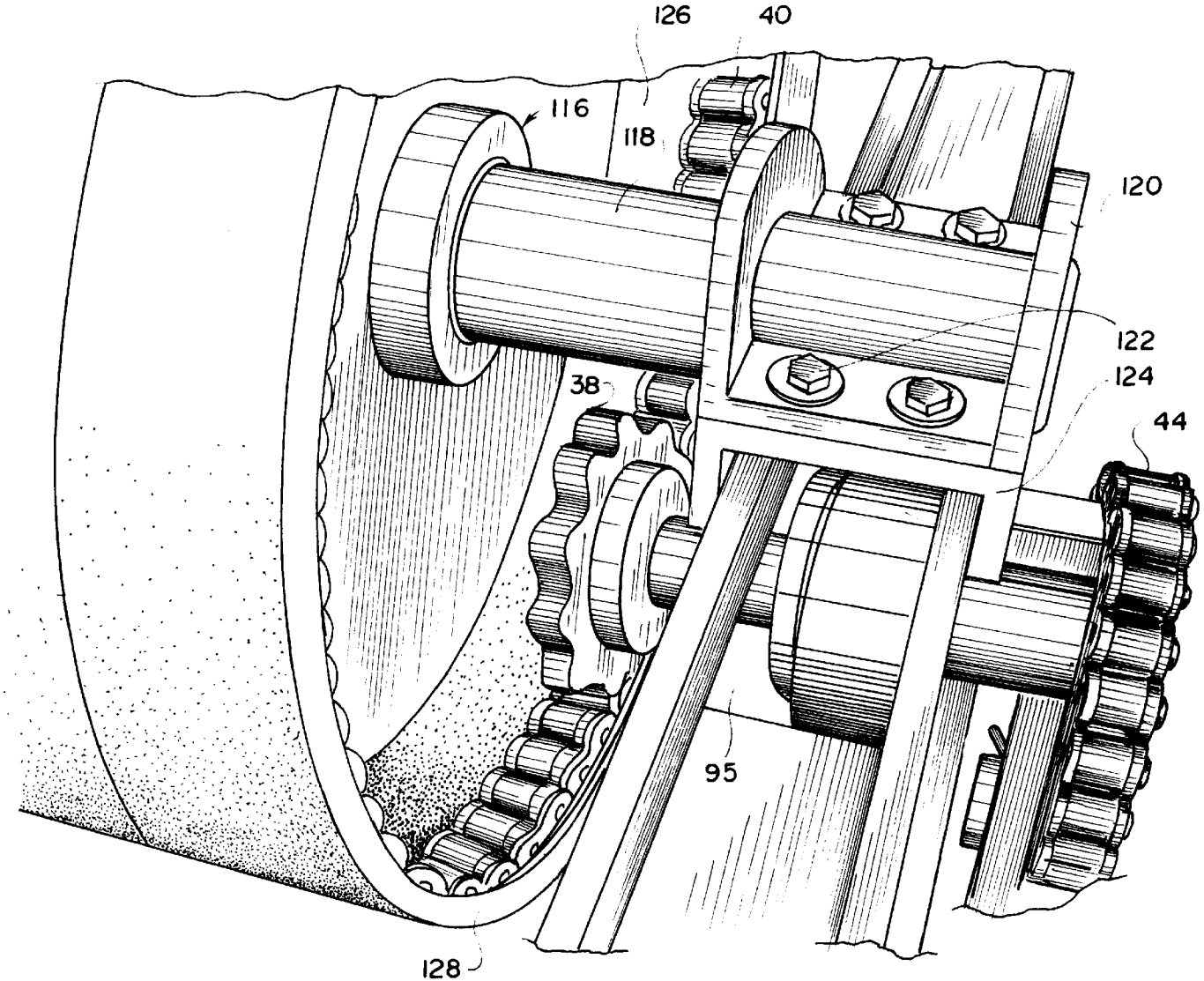
FIG. 4 is a detail perspective view of the gear assembly with the sprocket wheel engaged with the spool.

During operation, when the necessary alignment of the sprocket 38 in relation to the chain 40 is made and the teeth of the sprocket 38 are in place with the chain 40, as seen in FIG. 4, the handle 74 is removed from the adjusting screw 39, and the adjusting screw is free to rotate along with sleeve 70 and shaft 36. Thus, telescopic movement of the shaft 36 in relation to the sleeve 70 is prevented. Telescopic movement is also prevented when the teeth of the sprocket 38 are meshed with the chain 40.

As further shown in FIG. 5, the drive mechanism is provided with a flow control device 150 connectable to a hydraulic conduit 152 that connects to the hose 34, as shown in FIGS. 1 and 2. A valve 154, for example a directional valve, is positioned downstream from the flow control means 150 to allow a fluid flow through the drive mechanism.

The removable detachable portion 14 comprises a support base 80 formed by an upper plate 82 and vertically extending perimeter wall 84. A cutout, or recess 86 is formed in the perimeter wall 84 to allow engagement with a protruding part of the support frame 56, as shown in FIG. 2. A plurality of corner brackets 88 securely engage the four comers of the support base 80 when the removable portion is mounted on the base 18. When resting on the plate 22, the support base 80 is prevented from lateral movement by the shoulders 90 defining the cutout 86, as well as by the corner brackets 88.

Extending upwardly from the top plate 82 are a plurality of supporting legs 92 that have a length sufficient to allow a transverse beam 94 to reach an upper part of the bearings 50 and the chain 44. The transverse beam 94 has a U-shaped cross section and is provided with a central opening 95, which receives an upper portion of the bearings 50 (See FIG. 4).

An opening 96 is formed in the support base 80, the opening 96 having dimensions similar to the opening 24 of the base 16. A plurality of lifting members 98 with openings 100 are secured to the top plate 82 in order to allow lifting of the removable portion 14 by crane, or other suitable means.

A cable receiving bobbin or spool 110 is carried by the legs 92. The spool 110 comprises a cylindrical body 112 carrying a pair of ring, or circumferential flanges 114 secured to an exterior thereof a distance from opposite ends of the cylindrical body 112. The diameter of each of the flanges 114 is greater than the outside diameter of the cylindrical body 112 to allow retaining of a predetermined length of a cable, or an anchor chain wound on the bobbin 110.

Figure 7:
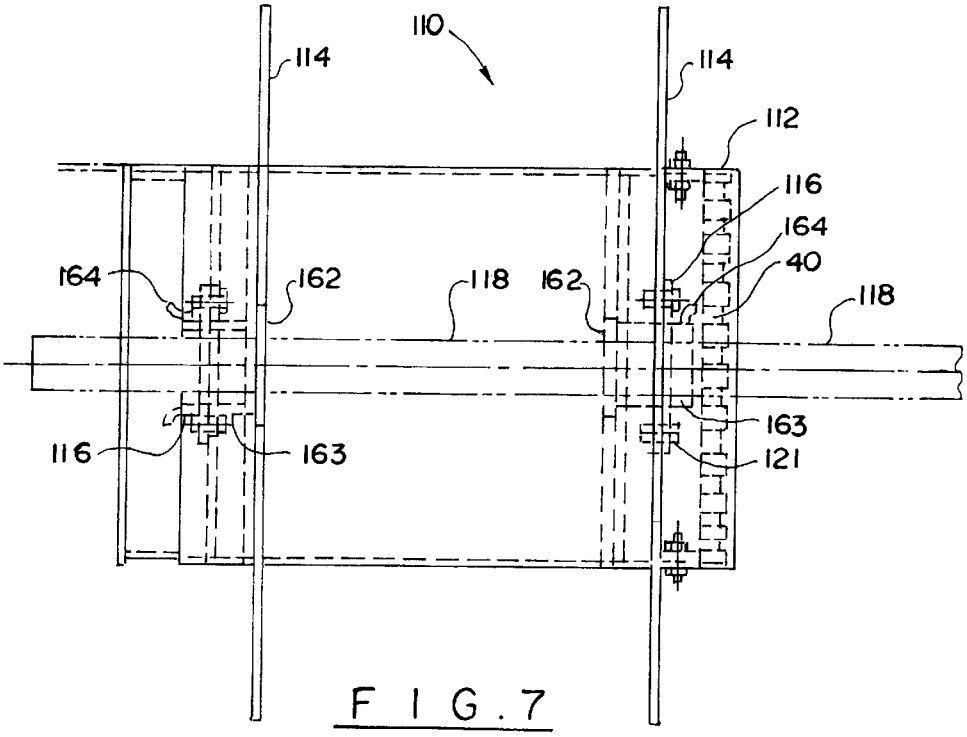
FIG. 7 is a detail view showing a rotating drum shaft assembly.

Turning now to FIG. 7, the cylindrical body 112 is fitted with flanges 114 secured by, for example, welding to the wall of body 112. A shaft 118 extends between opposing beams of the transverse frame 94 and through the spool 110. The shaft 118 is fixedly secured at both ends to the transverse frame 94 by attachment brackets 120 and 124, seen in FIGS. 4 and 9. A closer view of the brackets 120 and 124 is provided in FIGS. 3 and 4. The brackets consist of a lower portion 124 that is secured to the frame 94 by, for example, welding. The bracket 124 has in inverted U-shaped cross section and engages upwardly extending walls of the transverse beam 94. The upper attachment bracket 120 clamps over the ends of the drum shaft 118 that rests in the lower attachment bracket 124 and is firmly secured to the lower bracket 124 with bolts 122, as seen in FIGS. 3 and 4, thus holding the drum shaft 118 firmly in place.

Attached and secured to the drum shaft 118 are thrust bearings 162 (see FIG. 7) which prevent the lateral movement of the drum assembly 110 in relation to the drum shaft 118. The drum assembly 110 is further fitted with second bearings 163 that allow easy rotation of the drum 110 on the shaft 118 when torque is transmitted through the motor 32, the rotating sleeve 70 and the shaft 36. The thrust bearing assemblies 162, 163 are provided with conduits for delivering lubricant, as needed. The conduits can be as simple as grease nipples 164, as shown in FIG. 7.

Figure 3:
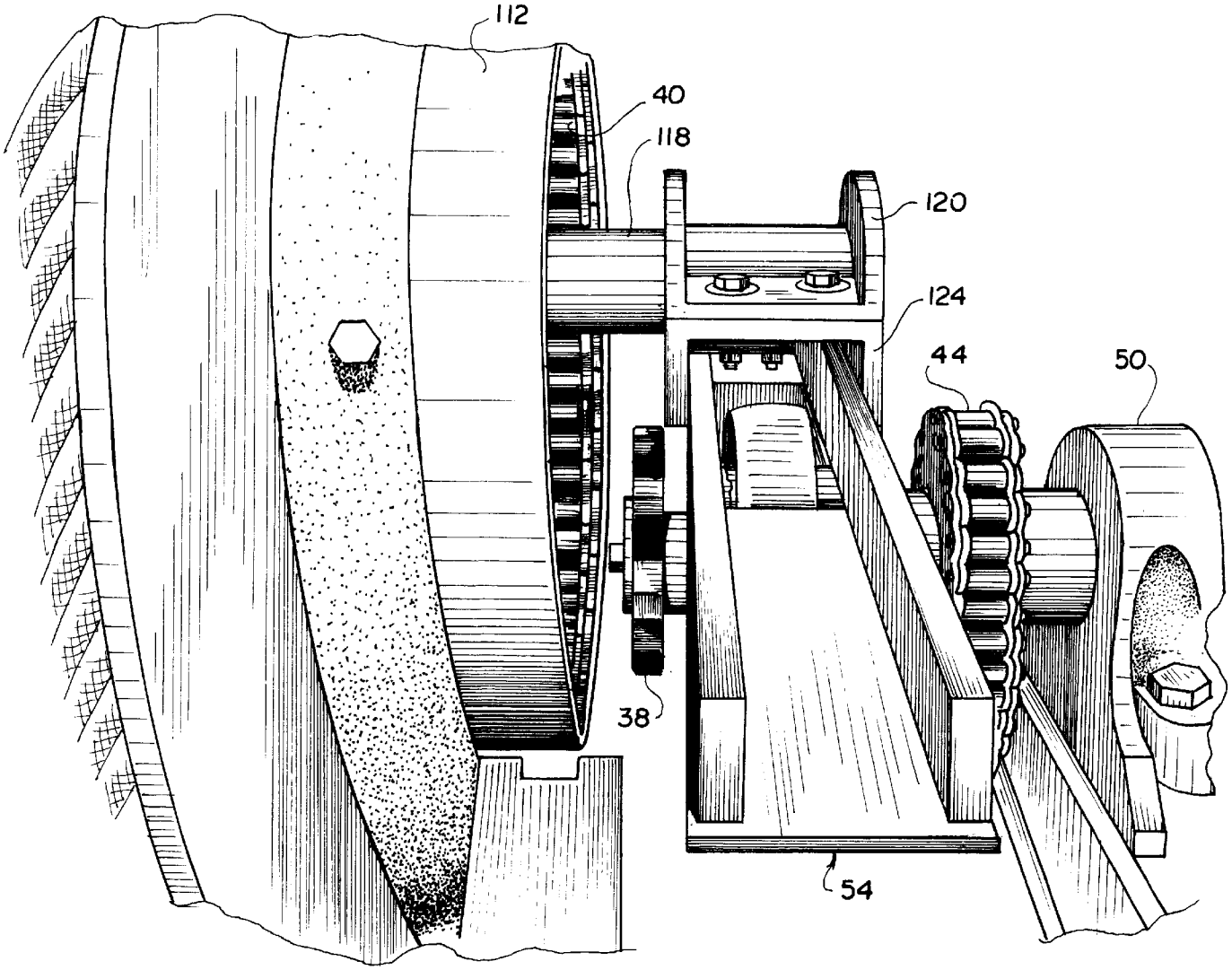
FIG. 3 is a detail view of a view of the gear assembly, with the sprocket wheel disengaged.

Turning now to FIGS. 3, 4 and 7 of the drawings, the end of the cylindrical body 112 and the drum shaft assembly can be seen in more detail. The endless chain 40 is fitted on the interior wall 126 of the body 112 and is secured thereto in a conventional manner. The chain 40 is retained in place by an annular inwardly extending lip 128 formed about the circumference of the cylindrical body 112. The links of the chain 40 are sized and shaped to engage the plurality of teeth of the sprocket wheel 38 when the sprocket wheel 38 is rotated. As a result, a rotating force is transmitted from the shaft 36 to the spool 110.

If desired, the drive mechanism can be a hydraulic motor, with an oil pump that delivers oil under pressure to a motor and drives the sprockets for rotation of the drum, or spool 110.

To ensure safety of operation, the second end 126 of the spool 110 is provided with a braking means. The braking means comprises a band 128 (see FIG. 2) positioned about the exterior circumference of the cylindrical body 112 between the flange 114 and the end 126. The ends of the band 128 are engaged in a gripping member 130 and are secured together by a threaded screw 132. The threaded screw 132 passes through the gripping member 130 and through the openings (not shown) formed in the ends of the band 128, causing the ends of the band 128 to come closer together when a wheel 134 is rotated. The wheel 134 is fixedly secured to the screw 132, allowing to apply an emergency brake on rotation of the spool 110, when necessary.

Figure 8:
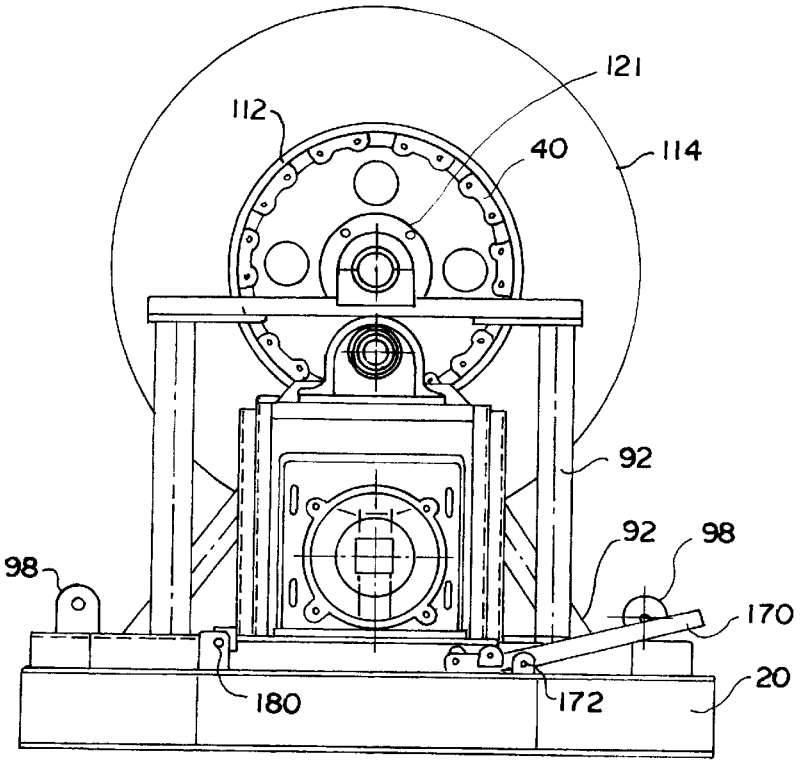
FIG. 8 is an end elevational view showing a motor assembly mounted on a base.
Figure 9:
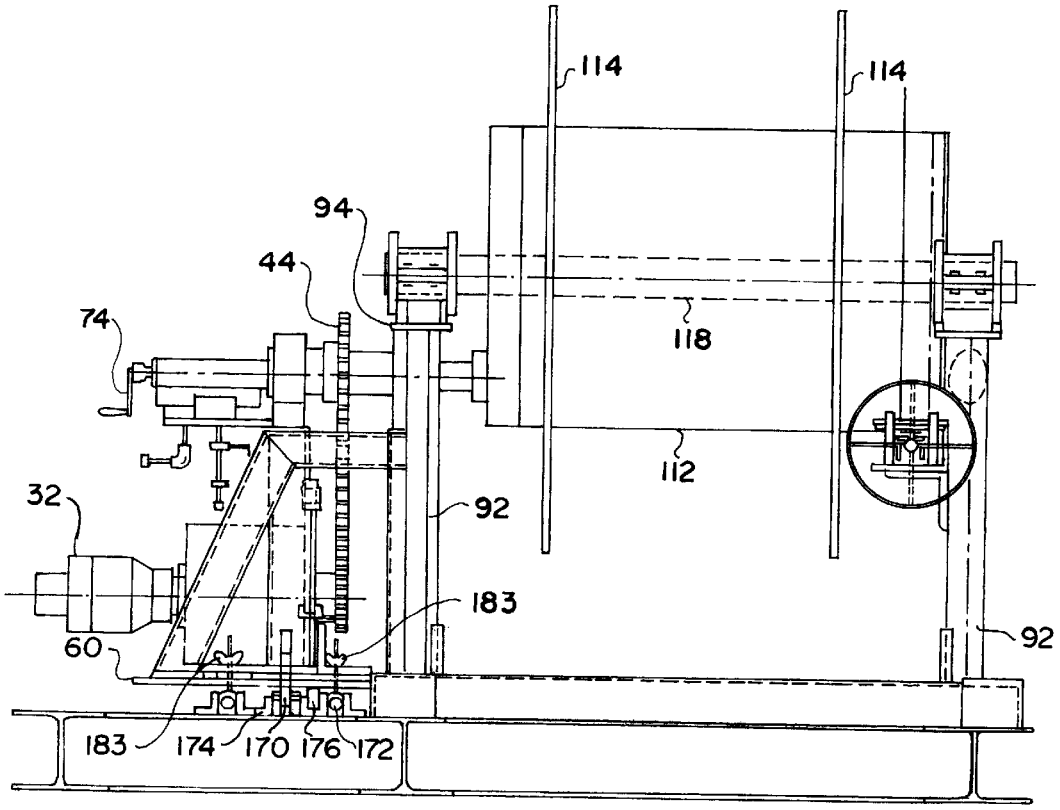
FIG. 9 is a side elevational view of the apparatus in accordance with the present invention.

Turning now to FIGS. 8 and 9, a means for lifting the drive mechanism is illustrated. A lever bar 170 is shown pivotally connected by a pin 172 fixed between two brackets 174 and 176 (FIG. 9). When the bar 170 is pushed downward, it acts as a fulcrum that raises the platform 60 on which the drive mechanism rests. The opposite end of that platform is hingedly attached, as at 180, to the base 20, so that the drive mechanism is lifted by the lever 170 at one end, while being hingedly attached to the base at the other side. The lifting of the drive mechanism is sufficient to allow the sprocket 38 to clear the chain 40 and thus clear the spool 110, so that the spool can be removed or placed on the base 12, if necessary. Once the sprocket 38 is raised above chain 40, it may be extended or retracted via handle 74 for engagement or disengagement with the chain 40, respectively, as desired. By lowering the lever 170, the drive mechanism is raised allowing the sprocket 38 to clear the chain 40 and allowing the elongated shaft 36 to be retracted away from the spool 110. The spool 110 can then be removed, a new spool put in its place, the elongated shaft extended, and the drive mechanism lowered to bring the sprocket 38 in contact with the chain 40.

Once the lever 170 is moved downward, it will remain in the desired position without the necessity to hold it in the downward position. The lever 170 is sufficiently stable to hold itself against the bottom of the base on which the drive mechanism is supported. When necessary, the lever 170 is moved up again, releasing the hinge mechanism and allowing the drive portion to return to its original position. During operation, the weight of the drive mechanism is sufficient to maintain the sprocket 38 engaged with the chain 40 on the drum assembly 110 and if desired, it could be further secured by wing nuts 183 (see FIG. 9).

In operation, the removable portion 14 is lifted by crane cables engaged with the lifting brackets 98 by hooks 142 and moved to rest on the stationary portion 12, that is stationed on a platform deck at a location where winding of the cable is convenient.

The removable portion 14 is manipulated to securely engage with the base 16, resting between the corner brackets 88 with the cutout 86 engaging at least a portion of the motor support frame 56, as shown in FIG. 2. The lifting cables 140 may be disengaged, if desired, from the lifting brackets 98, and an operator turns the handle 74 to advance the shaft 36 and thus the sprocket 38. Rotation of the crank handle 74 continues until the sprocket wheel 38 advances to a position in alignment with the chain 40. If necessary, the lever 170 is manipulated to align the driving chains 40 and the sprocket 38 to permit transmission of torque from the motor 32 to the spool 110.

Once the teeth of the sprocket 38 are firmly engaged with the chain 40, an operator secures one end of the cable with the cylindrical body 112, between the flanges 114. The cable is schematically shown in phantom lines 200 in FIG. 2. The operator then pushes control buttons on a control panel 210 (schematically shown in FIG. 1) connected to the motor 32.

The motor 32 causes rotation of the drive shaft 42, transmitting torque to the shaft 36 through the chain 44. Torque is then transmitted to the sprocket 38 and thereby, to the chain 40 and the spool 110. Rotation of the spool 110 causes winding of the cable 200 on the cylindrical body 112. The rotation continues until the desired length of the cable, or anchor chain is positioned on the spool 110. The free end of the cable is securely fastened, in a conventional manner, to the spool 110 to prevent accidental unwinding thereof.

After the sprocket 38 is lifted out of engagement with chain 40 by lifting the drive mechanism with lever 170, the handle 74 is then rotated to move the shaft 36 away from the spool 110 and disengage the sprocket 38 from engagement with the chain 40. An operator then attaches the hook 142 to the lifting brackets 98. The entire removable portion 14, along with the spool 110 and the cable wound thereon is lifted from the stationary portion 12 and moved to storage in a convenient location. The spool 110 can be stored either on the deck of the platform, away from the main operation areas, or on a service barge, or vessel attached to the platform.

Another removable portion 14 with an empty spool 110 is then positioned on the stationary portion 12, allowing to wind another length of cable or chain on the fresh spool in the manner described above. As a result, the stationary portion 12 can be used for winding of any length of cable, as long as there are enough spools 110 to store the cable.

The present invention allows to efficiently and expeditiously prepare for storage a considerable length of cables, as they are retrieved from the ocean, and store them in an organized manner, ready for future use. Cables do not occupy more space than the dimensions of the removable portions 14, they can be easily unwound, when necessary, by moving the removable portion 14 to a location where the cable, or chain or required. The wound cable, or chain can be transported to another convenient location, if desired, in an efficient, timely manner.

This invention of course, is not limited in its application to offshore platforms as it can be successfully used in any location where lengths of cables, ropes or chains need to be stored.

For example, the device of the present invention can be successfully used for winding up a length of pipe or conduit, that is conventionally laid on the bottom of the ocean floor at an oil or gas production site. Such pipes are usually manufactured as continuous lengths of conduits at an iron, or steel mill, and then are cut into predetermined lengths. The present invention can be used for transporting such lengths of pipe to a site where the pipe is to be positioned. In such a case, the diameter of the drum 110 can be sufficiently enlarged to allow winding of considerable lengths of pipe on the drum. The sprocket and chain mechanism of the present invention can be substituted by a gear and spline arrangement, if necessary.

Many other changes and modifications can be made in the design of the present invention without departing from the spirit thereof. I, therefore, pray that my rights to the present invention be limited only by the scope of the appended claims.

I claim:

1. A cable storage assembly comprising:

a stationary portion carrying a motor means for producing a rotational force; having a supporting frame a a removable portion having a supporting frame detachably engageable with said stationary portion, said removable portion comprising a spool with a spool shaft for receiving a length of cable wound thereon, a means carried by said spool for receiving rotational force produced by said motor means to facilitate winding of the cable on said spool; and a means for retaining said spool shaft stationary during rotation of said spool.

2. The assembly of claim 1, wherein said stationary portion comprises a support base having a first part for receiving the removable portion thereon and a second part for supporting the motor means.

3. The assembly o f claim 1, further comprising an elongated shaft operationally connected to a drive shaft of said motor means, said elongated shaft carrying a sprocket wheel on its first end and a rotating handle on its second end.

4. The assembly of claim 3, further comprising a sleeve for receiving at least a portion of said elongated shaft therein, and wherein rotation of said handle causes telescopic movement of said elongated shaft in relation to said sleeve.

5. The assembly of claim 4, wherein said spool comprises a cylindrical body and a pair of circumferential flanges secured adjacent to opposite ends of said cylindrical body.

6. The assembly of claim 1, wherein said removable portion is provided with means for allowing lifting of said removable portion.

7. The assembly of claim 6, wherein said means for allowing lifting comprises a plurality of lifting brackets fixedly attached to a base of said removable portion.

8. The assembly of claim 1, wherein said means for receiving rotational force carried by the spool comprises a chain rigidly secured to an interior wall of said spool, said chain being adapted for engagement with a sprocket wheel connected to a shaft of said motor means.

9. A cable storage assembly, comprising:

a stationary portion carrying a motor means for producing a rotational force;

a removable portion detachably engageable with said stationary portion, said removable portion comprising a spool for receiving a length of cable wound thereon and a means for receiving rotational force produced by said motor means to facilitate winding of the cable on said spool, said spool comprising a cylindrical body and a pair of circumferential flanges adjacent to opposite ends of said cylindrical body;

an elongated shaft operationally connected to a drive shaft of said motor means, said elongated shaft carrying a sprocket wheel on it first end and a rotating handle on its second end;

a sleeve for receiving at least a portion of said elongated shaft therein, said handle causing a telescopic movement of said elongated shaft in relation to said sleeve; and wherein a first end of said cylindrical body is provided with a chain rigidly secured to an interior wall of the cylindrical body, said chain being adapted for engagement with said sprocket wheel and for receiving torque transmitted by said elongated shaft from said motor means when the elongated shaft carrying said sprocket wheel is moved toward said first end of the cylindrical body.

10. A cable storage assembly, comprising:

a stationary portion carrying a motor means for producing a rotational force;

a removable portion detachably engageable with said stationary portion, said removable portion comprising a spool for receiving a length of cable wound thereon, a means for receiving rotational force produced by said motor means to facilitate winding of the cable on said spool and a braking means for interrupting rotation of said spool, said spool comprising a cylindrical body and a pair of circumferential flanges secured adjacent to opposite ends of said cylindrical body;

an elongated shaft operationally connected to a drive shaft of said motor means, said elongated shaft carrying a sprocket wheel on its first end and a rotating handle on its second end;

a sleeve for receiving at least a portion of said elongated shaft therein, rotation of said handle causing telescopic movement of said elongated shaft in relation to said sleeve.

11. The assembly of claim 10, wherein said braking means comprises a band mounted between a flange and an end of said cylindrical body, a gripping member engaging opposite ends of the band, a tightening screw for moving the opposite ends of the band toward each other, and a handle securely attached to said tightening screw for rotating said tightening screw and thereby applying braking force to the spool.

12. A cable storage assembly, comprising:

a stationary portion carrying a motor means for producing a rotational force, a means for receiving rotational force produced by said motor means to facilitate winding of the cable on said spool, said means for receiving rotational force comprising an elongated shaft operationally connected to a drive shaft of said motor means, said elongated shaft carrying a sprocket wheel on its first end and a rotating handle on its second end;

a removable portion detachably engageable with said stationary portion, said removable portion comprising a spool for receiving a length of cable wound thereon, said spool being provided with a chain rigidly secured to an interior wall of said spool, said chain being adapted for engagement with said sprocket wheel and for receiving torque transmitted by said elongated shaft from said motor means when said elongated shaft carrying said sprocket wheel is moved into engagement with said chain of the spool.

13. The assembly of claim 12, wherein said stationary portion comprises a support base having a first part for receiving the removable portion thereon and a second part for supporting the motor means, and wherein said removable portion is provided with means for allowing lifting of said removable portion.

14. The assembly of claim 13 wherein said means for allowing lifting comprises a plurality of lifting brackets fixedly attached to a base of said removable portion.

15. The assembly of claim 12, further comprising a sleeve for receiving at least a portion of said elongated shaft therein, and wherein rotation of said handle causes telescopic movement of the elongated shaft in relation to said sleeve and advancement of said sprocket toward said spool.

16. The assembly of claim 12, wherein said spool comprises a cylindrical body and a pair of circumferential flanges secured adjacent to opposite ends of said cylindrical body.

17. The assembly of claim 12, wherein said removable portion is provided with a braking means for interrupting rotation of said spool, said braking means comprising a band mounted between a flange and an end of said spool, a gripping member engaging opposite ends of the band, a tightening screw for moving opposite ends of the band toward each other and a handle securely attached to said tightening screw for rotating said tightening screw, thereby applying braking force to the spool.

18. A conduit storage assembly, comprising:

a stationary portion carrying a motor means for producing a rotational force;

a removable portion detachably engageable with said stationary portion, said removable portion comprising a spool for receiving a length of conduit wound thereon and a means for receiving a rotational force produced by said motor means to facilitate winding of the conduit on said spool, said spool being provided with a cylindrical body and a pair of spaced apart circumferential flanges, a first end of said cylindrical body being provided with a chain rigidly secured to an interior wall of the cylindrical body, said chain being adapted for operational connection to said motor means.

19. The assembly of claim 18, wherein said motor means is hingedly connected to said stationary portion to allow alignment of said means for receiving rotational force with said spool.

* * * * *